US011952778B2

(12) United States Patent
Albawab

(10) Patent No.: US 11,952,778 B2
(45) Date of Patent: Apr. 9, 2024

(54) MULTI-PURPOSE BUILDING BLOCK, AND A BUILDING SYSTEM COMPRISING THE SAME

(71) Applicant: Saeed Albawab, Amman (JO)

(72) Inventor: Saeed Albawab, Amman (JO)

( * ) Notice: Subject to any disclaimer, the term of this patent is extended or adjusted under 35 U.S.C. 154(b) by 19 days.

(21) Appl. No.: 17/614,469

(22) PCT Filed: May 20, 2020

(86) PCT No.: PCT/JO2020/050004
§ 371 (c)(1),
(2) Date: Nov. 26, 2021

(87) PCT Pub. No.: WO2020/240606
PCT Pub. Date: Dec. 3, 2020

(65) Prior Publication Data

US 2022/0228369 A1 Jul. 21, 2022

Related U.S. Application Data

(60) Provisional application No. 62/853,068, filed on May 27, 2019.

(51) Int. Cl.
*E04C 1/39* (2006.01)
*E04B 2/22* (2006.01)
*E04B 2/02* (2006.01)

(52) U.S. Cl.
CPC ..... *E04C 1/397* (2013.01); *E04B 2/22* (2013.01); *E04C 1/395* (2013.01); *E04B 2002/0236* (2013.01)

(58) Field of Classification Search
CPC ..... E04C 1/397; E04C 1/395; E04C 1/392; E04B 2/22; E04B 2002/0236
See application file for complete search history.

(56) References Cited

U.S. PATENT DOCUMENTS

| | | | | |
|---|---|---|---|---|
| 4,041,660 | A * | 8/1977 | Yensen | E04B 2/22 D25/113 |
| 4,854,097 | A | 8/1989 | Haener | |
| 5,644,877 | A | 7/1997 | Wood | |
| 6,253,519 | B1 | 7/2001 | Daniel | |
| 7,243,405 | B1 * | 7/2007 | Green | A61G 17/0136 27/35 |
| 2006/0059838 | A1 * | 3/2006 | Pimental | E04C 1/395 52/596 |
| 2014/0007529 | A1 | 1/2014 | Alvarez Moysen | |
| 2014/0196397 | A1 | 7/2014 | Sourlis et al. | |

(Continued)

*Primary Examiner* — Patrick J Maestri
(74) *Attorney, Agent, or Firm* — Oblon, McClelland, Maier & Neustadt, L.L.P.

(57) ABSTRACT

A building block may be designed to hold utilities, including but not limited to, electricity and plumbing. Such a building block can resist compression forces and moment and can connect to other building blocks to form a modular wall system with the ability to distribute the forces in a way that reduces the stresses on each individual block. The building block may include a body with an upper end and a lower end, one or more main compartments, and one or more inner pass-through openings, wherein the upper end includes one or more protrusions, and the lower end comprises one or more intrusions and one or more slots. A building system may include more than one such building blocks and a base.

20 Claims, 11 Drawing Sheets

(56) References Cited

U.S. PATENT DOCUMENTS

| | | | | |
|---|---|---|---|---|
| 2016/0017907 | A1* | 1/2016 | Ryan | E04B 2/12 403/381 |
| 2016/0123004 | A1 | 5/2016 | Lightfoot | |
| 2017/0202098 | A1* | 7/2017 | Gou | H05K 5/0204 |

* cited by examiner

MULTI-PURPOSE BUILDING BLOCK, AND A BUILDING SYSTEM COMPRISING THE SAME

CROSS-REFERENCE TO RELATED APPLICATIONS

The present application is the national stage of international application PCT/J02020/050004, filed on May 20, 2020, and claims the benefit of the filing date of U.S. Prov. Appl. No. 62/853,068, filed on May 27, 2019.

TECHNICAL FIELD

The present disclosure relates to modular building blocks and systems, and more particularly to a building block and a modular building system that can be used in building modular walls and architectural elements like columns and beams with utility holding capabilities.

BACKGROUND

Modular building blocks and walls are known in the art, most of them depend on existing walls. For instance, the U.S. Pat. No. 7,627,983 discloses a living wall made of a plurality of planter tiles and base tiles configured to be joined in edge abutting fashion to tessellate a vertical surface. Planter tiles include a curved coffer wall extending from a front surface of the base panel to define an upwardly opening container for soil and plants. Base tiles and planter tiles may be fabricated from a porous material that allows a soaker supply at the top of the tile layout to water the entire vertical matrix by seepage through the tiles.

The international patent publication number 2017058611 discloses a green wall that is designed to be utilized in warmer climates, such as subtropical and tropical climates, by utilizing hexagonal shaped modules for housing soil and vegetation. These hexagonal shaped modules overlap one another on a vertical structure (e.g., trellis) in such a manner as to shade underneath modules. Furthermore, these hexagonal shaped modules are slanted downward to aid in soil volume and thermal reduction as well as to keep roots cool and maximize water availability.

The U.S. patent publication number US20150176287 discloses a system for mounting wall panels to a wall includes wall panels, each including a main wall panel section, and four bent end sections extending from edges of the main wall panel section; a plurality of main fastening extrusions, each including a base secured to the wall, two spaced apart post walls extending from the base section, and two bent end securing walls extending from the base on opposite sides of each post wall, with a spacing between each post wall and an adjacent bent end securing wall being equal to the wall thickness of one bent end section; and a recess at a first surface of each bent end section which faces a second surface of a respective bent end securing wall, and a projection at the second surface of each bent end securing wall which is adapted to be received in a respective recess.

SUMMARY

It is an object of the present disclosure to provide a modular building block and a modular building system including a plurality of modular building blocks.

Aspects of the present disclosure provides a modular building block of a unique design that allows such modular block to resist bending moments, thus making such block suitable for building beams or columns with the ability of holding a variety of systems such as electrical wirings and/or fluids flowing in internal ducts.

In aspects of the present disclosure, the modular building block may include a body with an upper end and a lower end; one or more main compartments; and one or more inner pass-through openings, wherein the upper end may have a first upper cut, a second upper cut, and one or more protrusions, and wherein the lower end may have a first lower cut and one or more slots.

In some aspects, the body of the modular building block may have a shape substantially resembling a trapezoid.

In yet other aspects, the body of the modular building block may have a shape substantially resembling a hexagon.

In some aspects, the one or more main compartments may be configured to receive plants, books, or any other stuff.

In some aspects, the modular building block may further include a front separable cover 200 and a back separable cover 203, each having a plurality of fixtures 4, such front and back covers 200, 203 may be configured to cover the one or more main compartments.

In some aspects, the body of the modular building block may include a plurality of holes.

In some aspects, the modular building block of the present disclosure can be customized to address different problems, including but not limited to, heat insulation and sound insulation.

Aspects of the present disclosure further provide a building system including a plurality of the modular building blocks separably connected to each other vertically and horizontally, and a base.

In some aspects, the building system may further include means for fixing the system against a rigid body, such as a ceiling.

In some aspects, the means for fixing the system against the rigid body may include a body, power screws, and/or fixing elements.

The building system using the modular building block of the present disclosure can be considered as an architectural do-it-yourself project for both interior and exterior uses with minimal need for specialized tools. It can also be uninstalled easily without keeping any marks of permanent fixtures.

In some aspects, the building system of the present disclosure can be used for remodeling activities in an interior target space.

In some aspects, the building system of the present disclosure may be used for fishkeeping.

In other aspects, the one or more slots may be configured to receive the protrusion of a vertically adjacent building block in the building system of the present disclosure.

The base of the building system in accordance with embodiments of the present disclosure may include one or more openings to receive a substantial part of the modular building block, a lifting mechanism, and a handle in operable communication with the lifting mechanism.

In some aspects, the lifting mechanism may include scissors-type mechanism.

The lifting mechanism in aspects of the present disclosure may be configured to change the elevation of the modular building blocks in the system of the present disclosure. This would allow to fix the system in place against a ceiling.

BRIEF DESCRIPTION OF THE DRAWINGS

The disclosure will now be described with reference to the accompanying drawings, without however limiting the scope of protection thereto, and in which.

DETAILED DESCRIPTION

Figure 1:
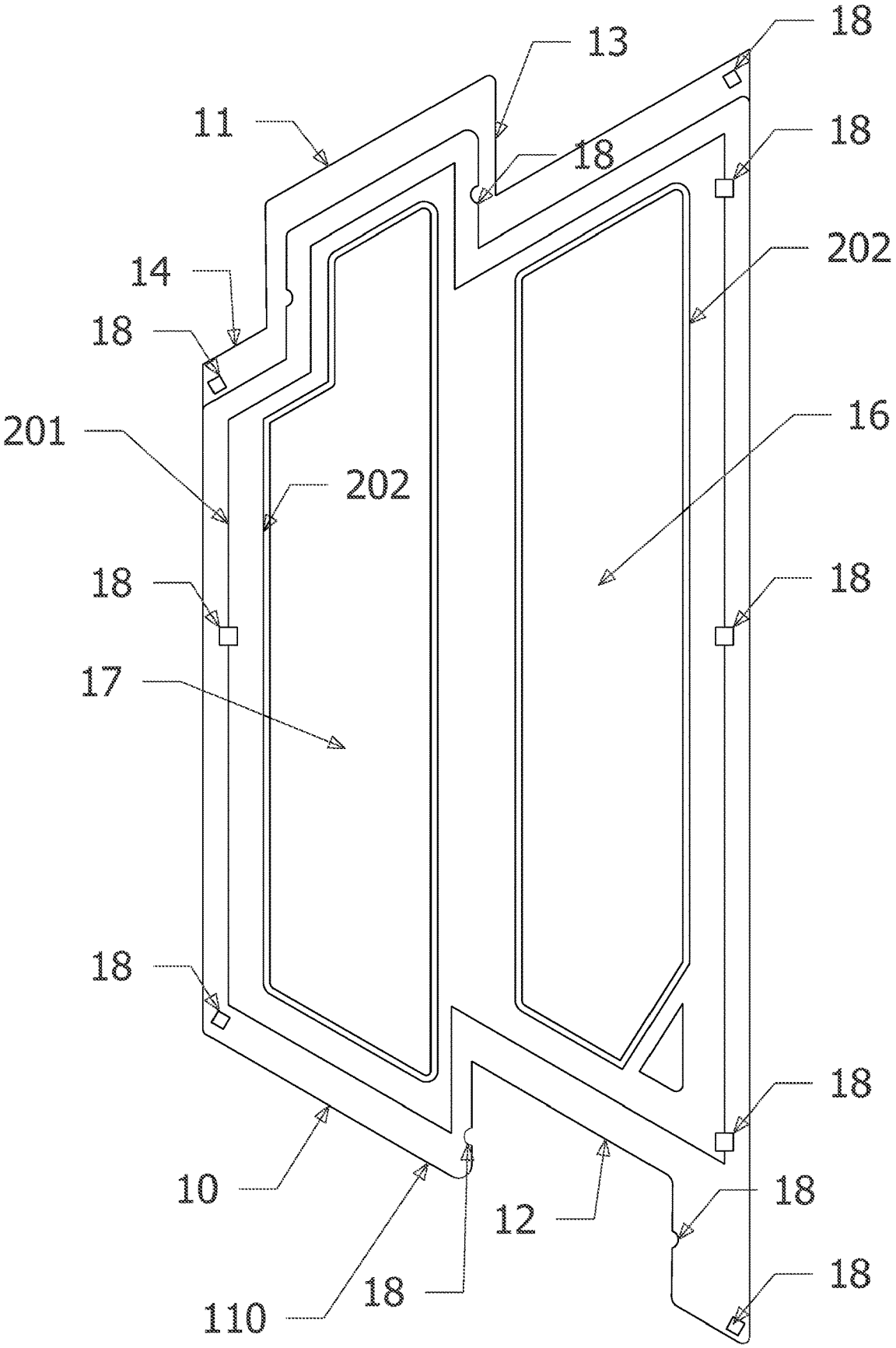
FIG. 1 illustrates a front view of a modular building block configured in accordance with embodiments of the present disclosure.
Figure 2:
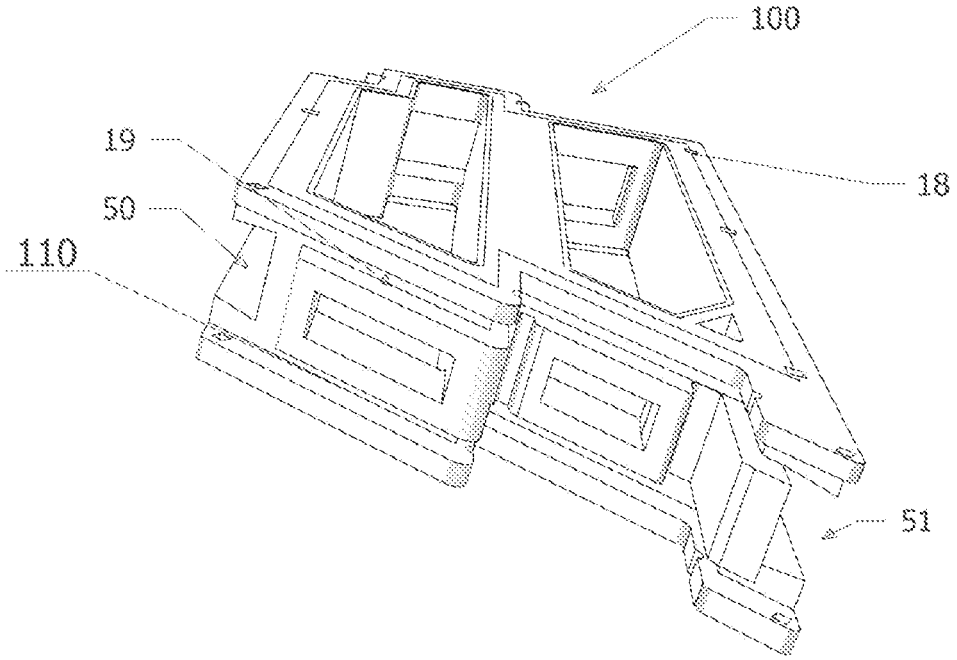
FIG. 2 illustrates a lower perspective view of a modular building block configured in accordance with embodiments of the present disclosure.
Figure 3:
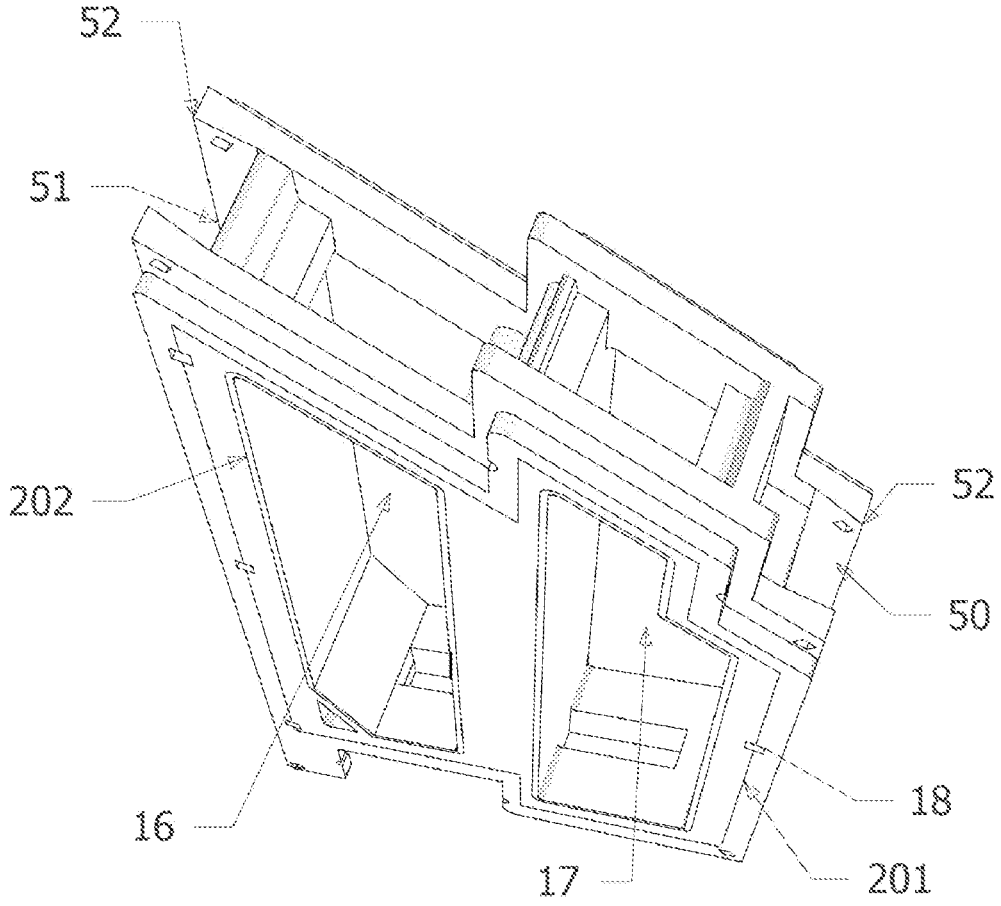
FIG. 3 illustrates an upper perspective view of a modular building block configured in accordance with embodiments of the present disclosure.
Figure 4:
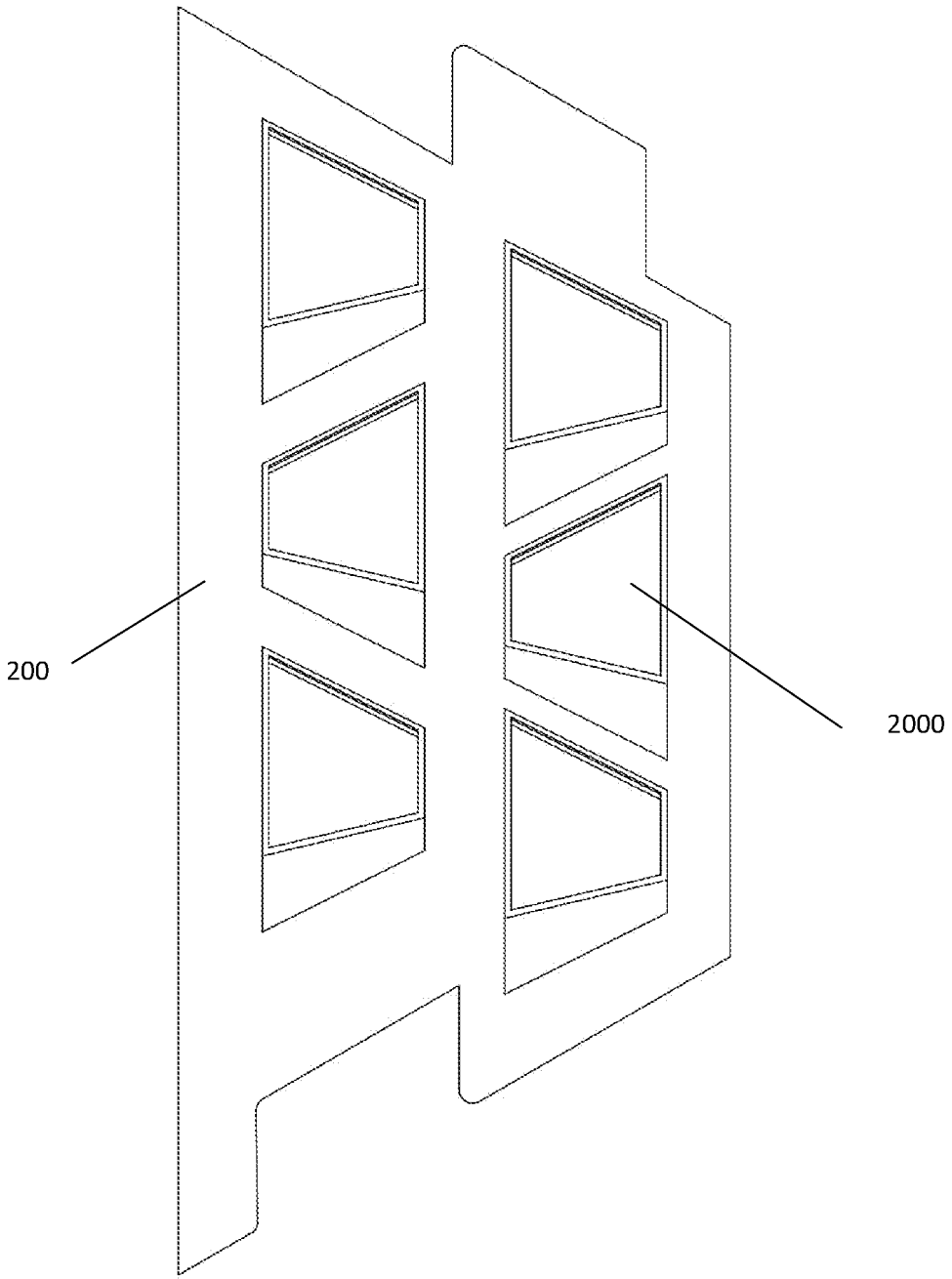
FIG. 4 illustrates a front view of a front separable cover of a modular building block configured in accordance with embodiments of the present disclosure.
Figure 5:
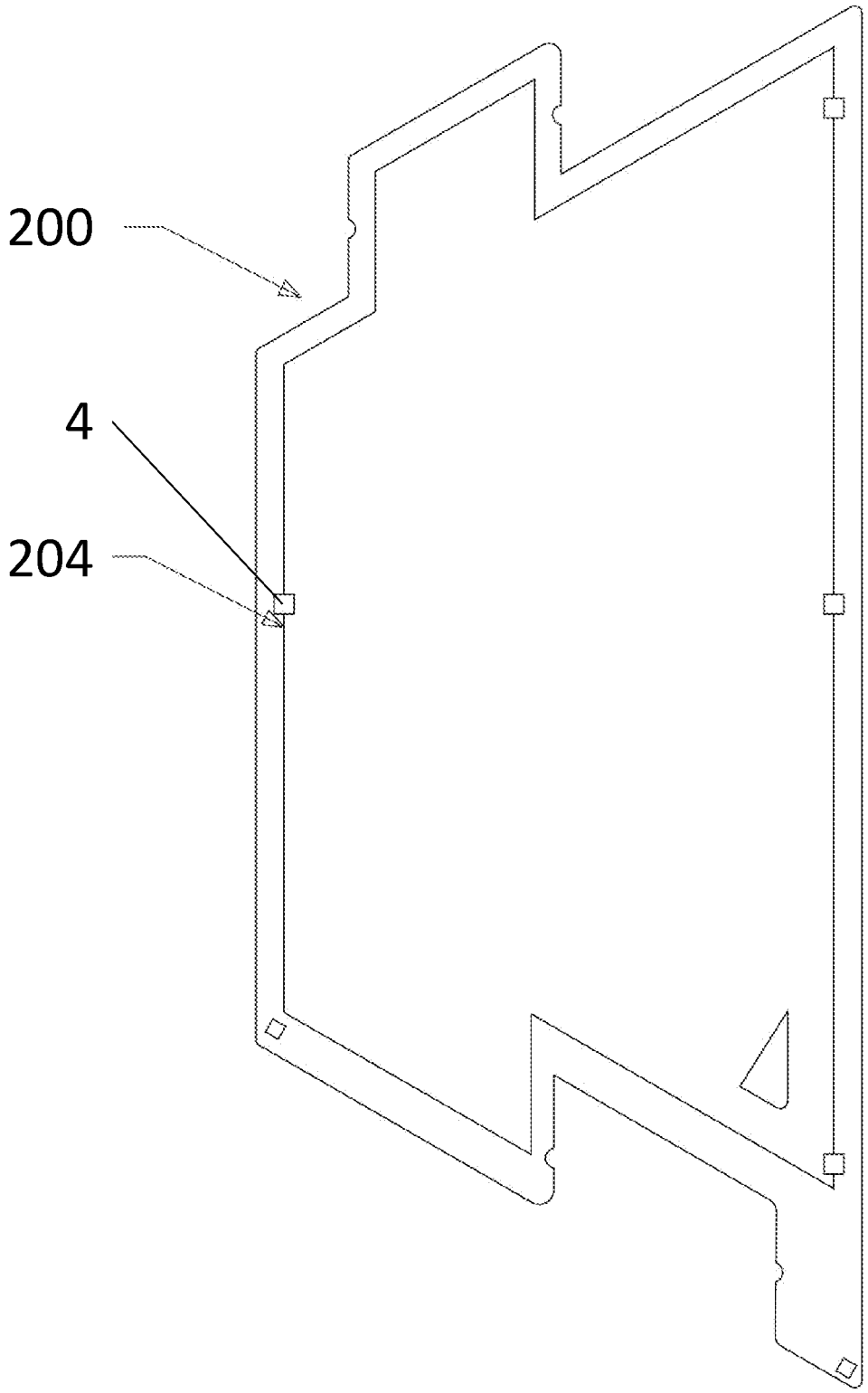
FIG. 5 illustrates a back view of a front separable cover of a modular building block configured in accordance with embodiments of the present disclosure.
Figure 6:
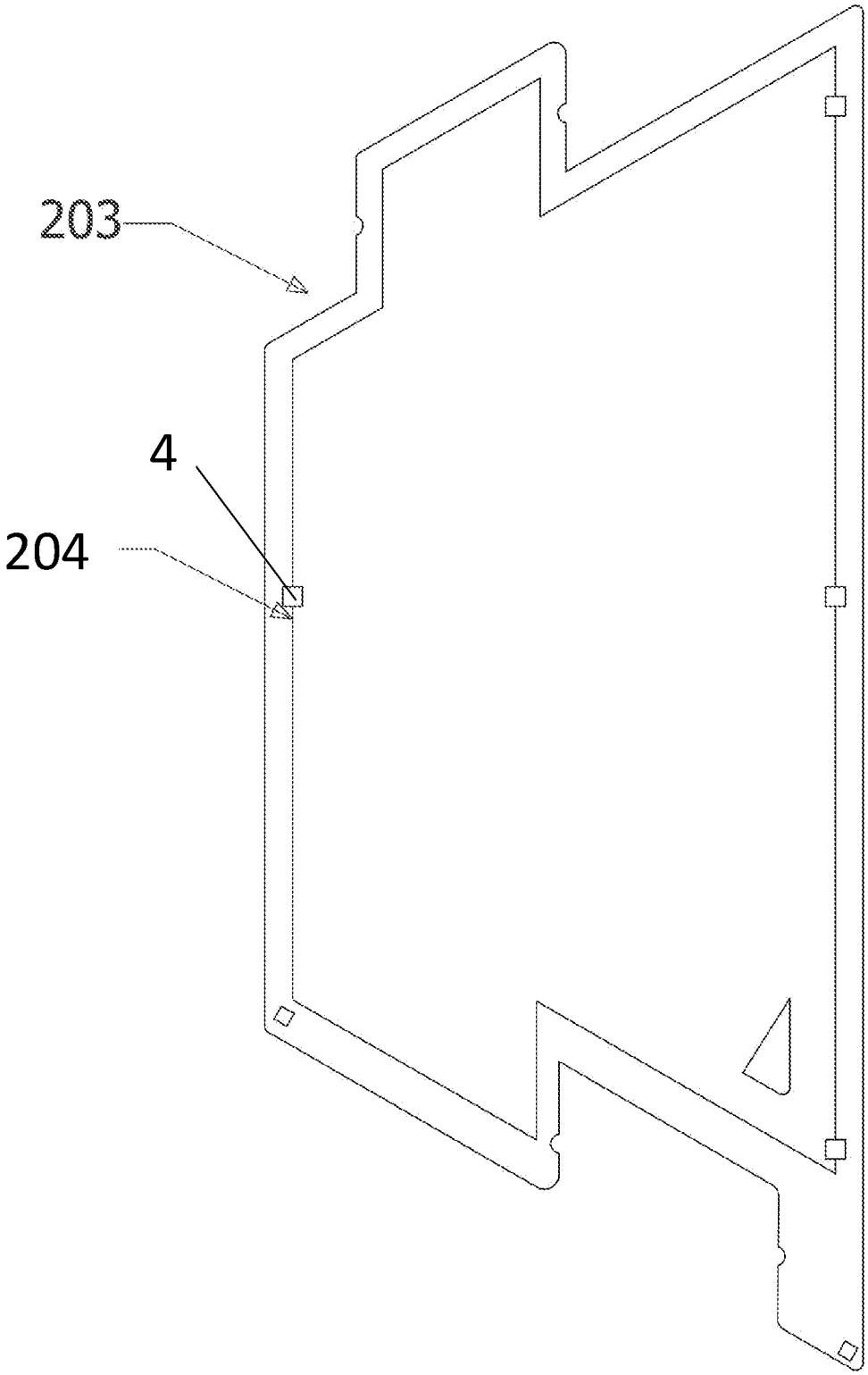
FIG. 6 illustrates a back view of a back separable cover of a modular building block configured in accordance with embodiments of the present disclosure.

Referring to FIGS. 1-3, the present disclosure provides a modular multi-purpose building block configured in accordance with embodiments of the present disclosure, the multi-purpose building block in embodiments of the present disclosure may include a body 100 with a lower end 10 and an upper end 11. The upper end 11 may have a first upper cut 13, a second upper cut 14, and one or more protrusions 15. The lower end 10 may have a first lower cut 12, a second lower cut 120, and one or more slots 110. The modular building block of the present disclosure may further include one or more main compartments, i.e. a first main compartment 16, a second main compartment 17, and one or more inner pass-through opening 19.

The body 100 may further include a first set of tapered lateral protrusions that may define a first dove-tail lateral passageway 50, and a second set of tapered lateral protrusions that may define a second dove-tail lateral passageway 51.

Figure 7:
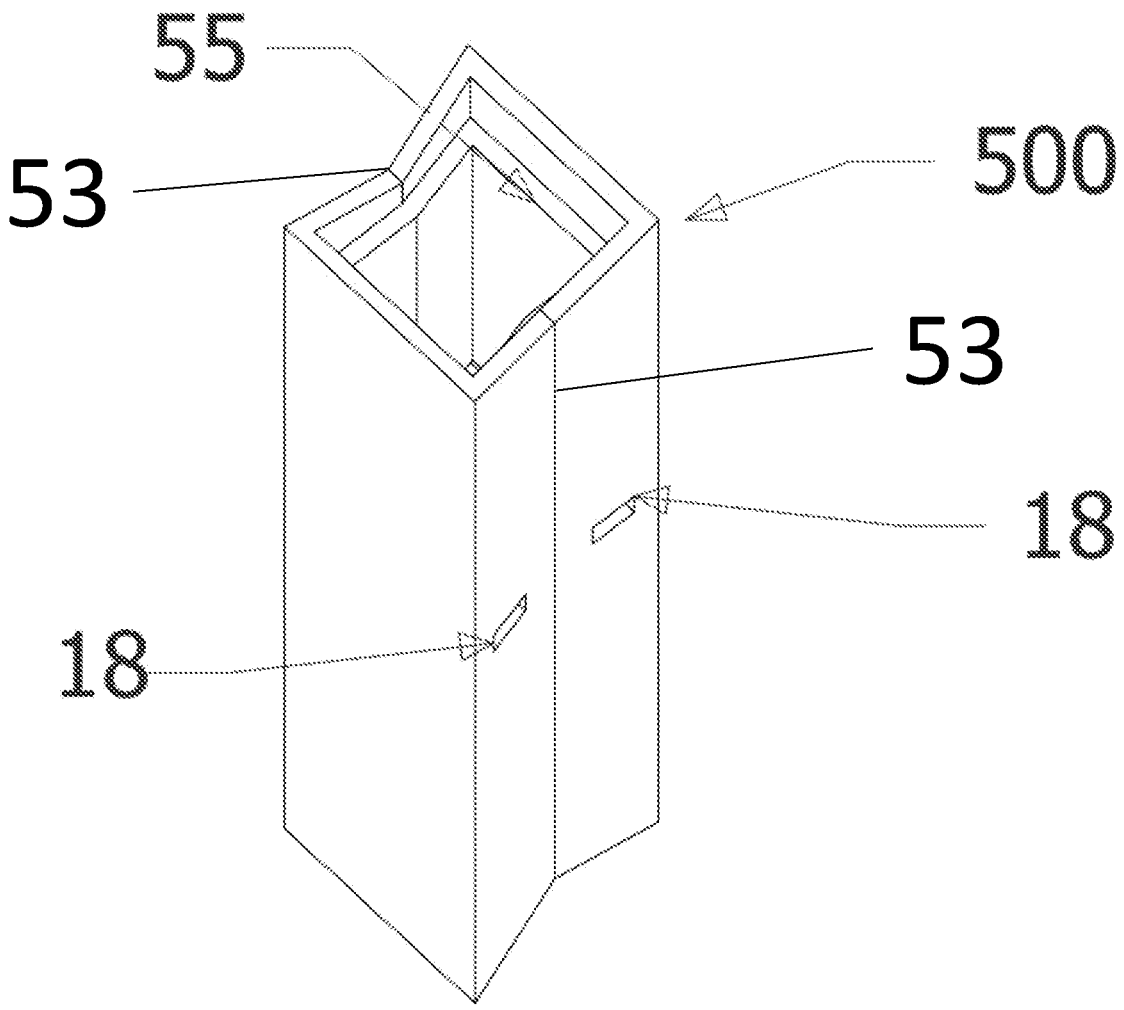
FIG. 7 illustrates a perspective view of a first joining member of a modular building block configured in accordance with embodiments of the present disclosure.
Figure 8:
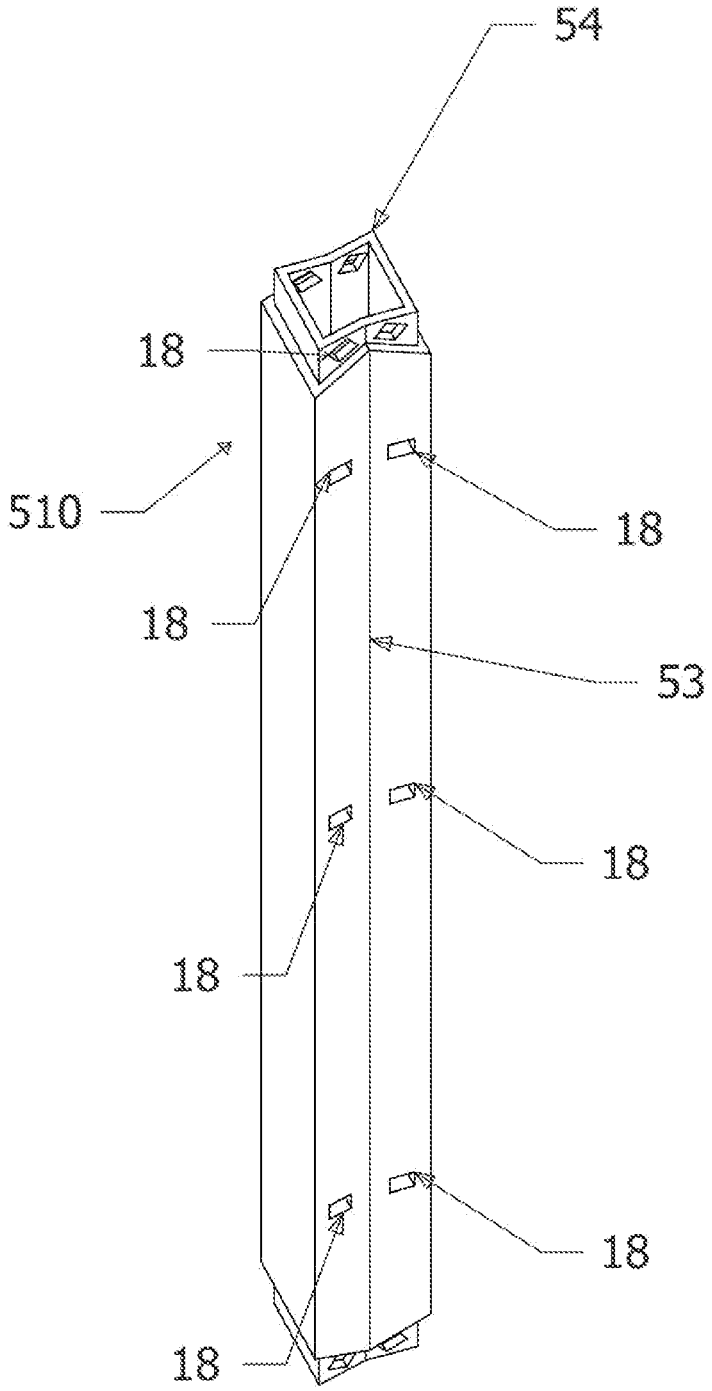
FIG. 8 illustrates a perspective view of a second joining member of a modular building block configured in accordance with embodiments of the present disclosure.
Figure 9:
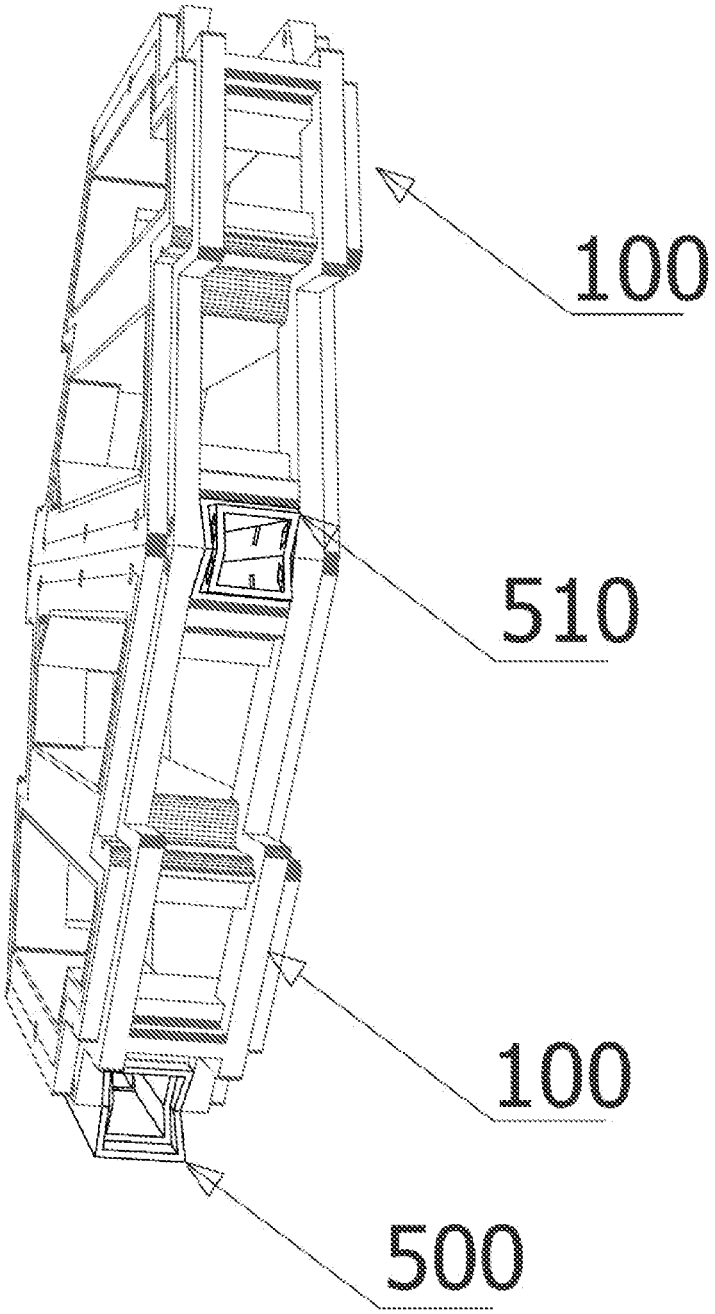
FIG. 9 illustrates upper perspective view of two modular building blocks configured in accordance with embodiments of the present disclosure horizontally connected with each other.

Reference is now being made to FIGS. 7-9 with continued reference to FIGS. 1-3. In order to connect two horizontally adjacent blocks in embodiments of the present disclosure, the edges of the first dove-tail passageway 50 of two horizontally adjacent blocks are mated with each other, and a first joining member 500 is inserted in the space gap formed by mating the edges of the two passageways 50. Alternatively, the edges of the second dove-tail passageway 51 of two horizontally adjacent blocks are mated with each other, and a second joining member 510 is inserted in the space gap formed by mating the edges of the two passageways 51.

In embodiments of the present disclosure, the first joining member 500 may be a tube-like element having a polygonal profile having substantially a square shape with two opposed indentations 53. The opposed indentations allow for the insertion of the first joining member 500 to be inserted in the space gap formed by mating the edges of the two passageways 50. The first joining element 500 may also have two opposed intrusions 55, each in proximity to one end of the member. It may also have a plurality of holes 18 that are configured to receive fixtures of the front cover 200 or the back cover 203.

In embodiments of the present disclosure, the second joining member 510 may be a tube-like element having a polygonal profile having substantially a square shape with two opposed indentations 53. The opposed indentations allow for the insertion of the second joining member 510 to be inserted in the space gap formed by mating the edges of the two passageways 51. The second joining element 510 may also have two opposed extrusions 54, each in proximity to one end of the member. It may also have a plurality of holes 18 that are configured to receive fixtures of the front cover 200 or the back cover 203.

The intrusions 55 of the first joining member 500 may be configured to receive the extrusions 54 of the second joining member 510 of a vertically adjacent connection between two modular building blocks configured in accordance with embodiments of the present disclosure.

In embodiments of the present disclosure, the lower end 10 may be configured to receive an upper end 11 of an adjacent modular multi-purpose building block, such that each of the one or more slots 110 may be configured to receive one of the one or more protrusions 15 of the adjacent block. Such reception allows two adjacent blocks to be vertically interlocked with each other.

When a block of the present disclosure is interlocked with the vertically adjacent block, the inner pass-through openings 19 of the two blocks may form a duct-shaped space gap. Such space gap may be air-tight to be capable of receiving electrical or telecommunications wiring, and/or plumbing connections or flowing fluids when chambers are water-tight.

In embodiments of the present disclosure, the first and second main compartments 16, 17 may be configured to receive plants, books or any other stuff.

Referring now to FIGS. 1-6, in embodiments of the present disclosure, the modular multi-purpose building block may have a plurality of holes 18, such holes are configured to receive fixtures of a front cover 200 and back cover 203 and/or pins 4 to further provide robustness and cover the first and second main compartments 16, 17.

In embodiments of the present disclosure, the connection between the front and back covers 200, 203 and the plurality of holes 18 may be achieved through a press-fit mechanism. The body 100 may further include one or more grooves, for example two grooves 201, 202 that are configured to receive gaskets and/or protrusions 204 of the font and back covers 200, 203.

In embodiments of the present disclosure, the front cover 200 may include one or more planting pots 2000 configured to receive one or more plants.

In some embodiments, the body 100 may have a shape substantially resembling a trapezoid.

In other embodiments, the body 100 may have a shape substantially resembling a hexagon.

The design of the modular building block as described in the present disclosure allows the building block to resist bending moments and compression forces and moment and can connect to other building blocks to form a modular wall system with the ability to distribute the forces in a way that reduces the stresses on each individual block.

Figure 10:
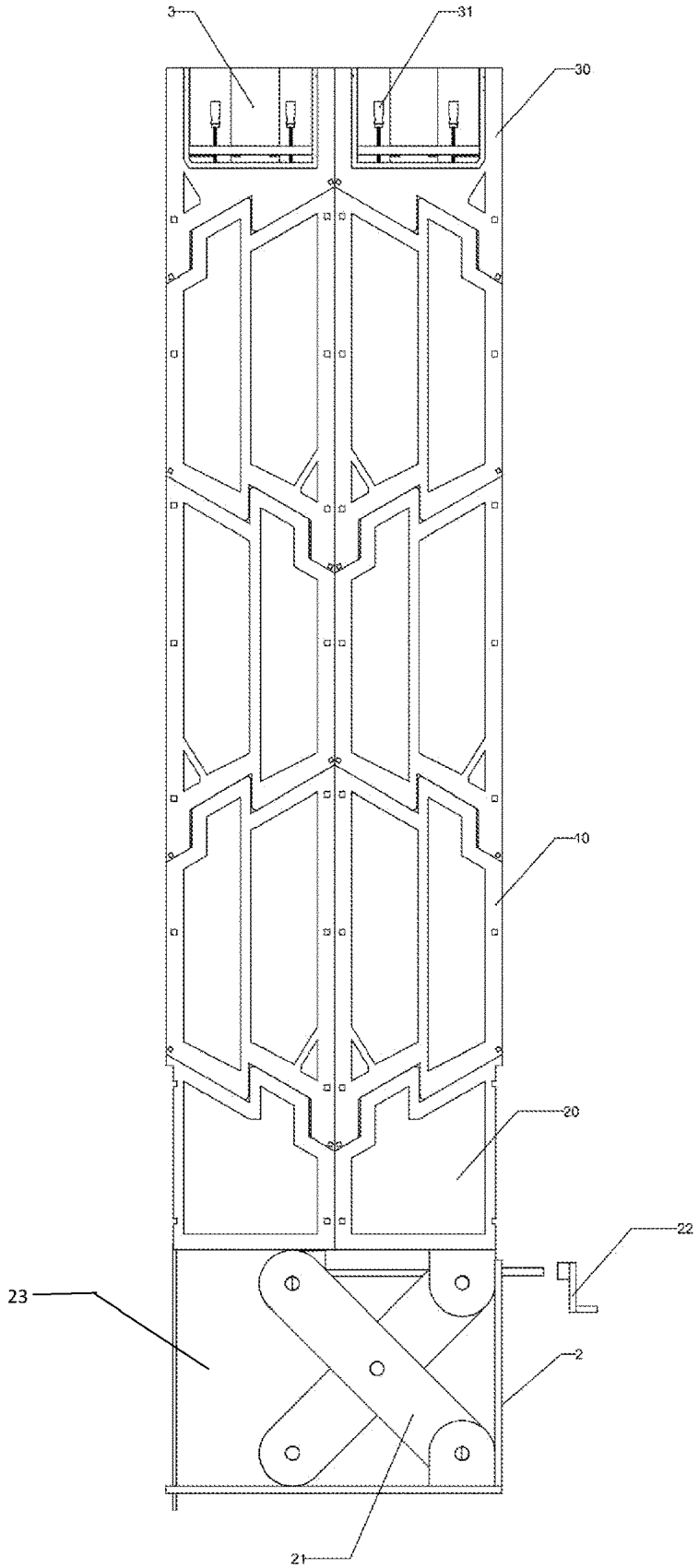
FIG. 10 illustrates a schematic diagram of a building system configured in accordance with embodiments of the present disclosure.
Figure 11:
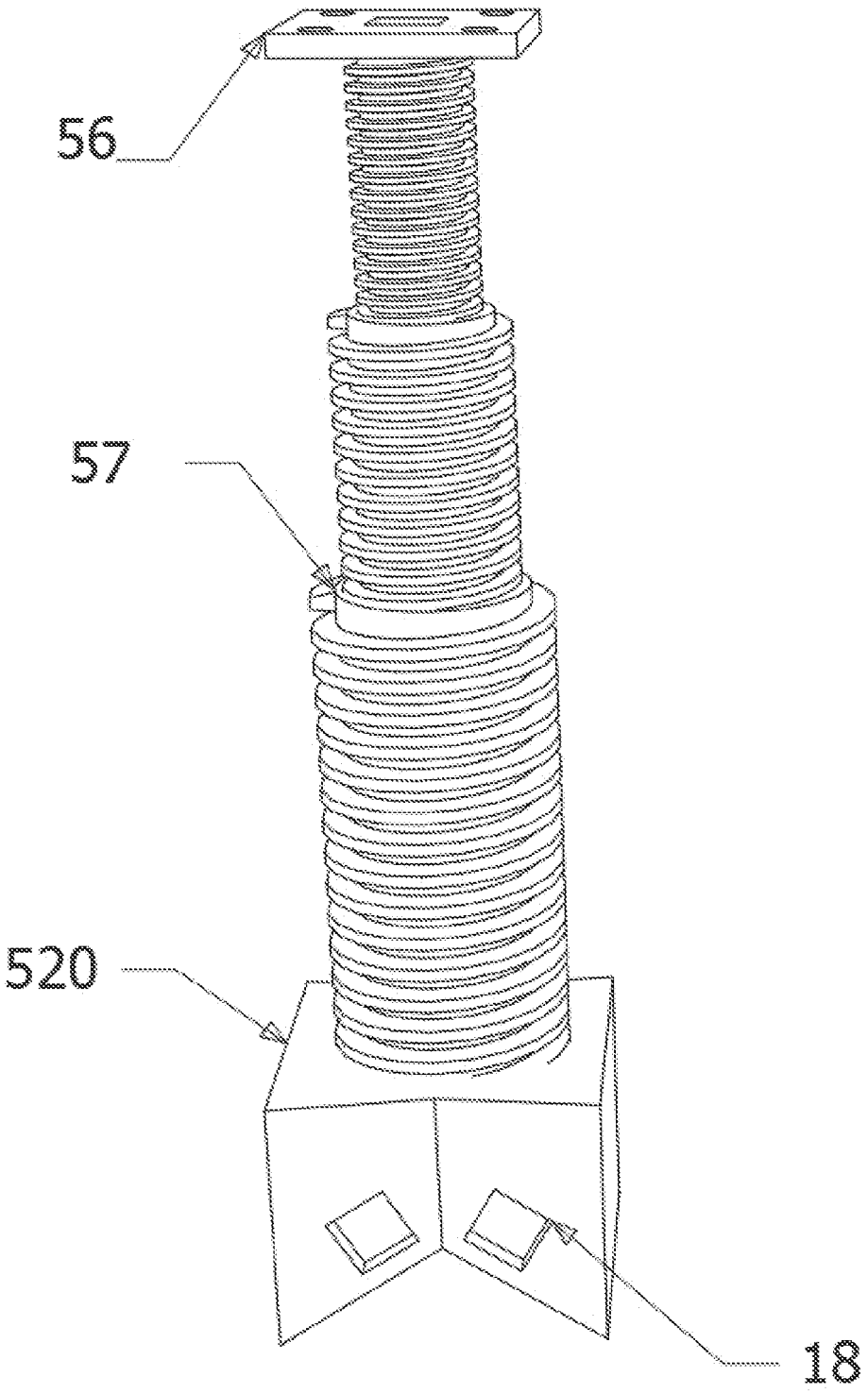
FIG. 11 illustrates a perspective view of exemplary means for fixing a building system configured in accordance with embodiments of the present disclosure against a rigid body.

Referring now to FIGS. 10-11, the present disclosure further provides a building system including one or more modular interlocked multi-purpose building blocks as described above in the present disclosure, and a base 2. The base 2 may include fixing elements 20 configured to receive a substantial part of the one or more modular multi-purpose building blocks, and a lifting mechanism 21 configured to change the elevation of the one or more modular multi-purpose building blocks with reference to a static rigid body, and a handle 22 configured to actuate the lifting mechanism 21.

In some embodiments, the fixing elements 20 may have a design that is substantially similar to the upper end of the body 100 of the building block of the present disclosure.

In some embodiments, the fixing elements may be separably connected to the base 2.

The interlocking action between two adjacent modular building in the system of the present disclosure allows the system to resist bending moments, thus making it suitable for constructing beams or columns.

In some embodiments, the lifting mechanism 21 may include a scissors-type lift.

In embodiments of the present disclosure, the base 2 may have a fluid reservoir 23.

In some embodiments, the base 2 may be in fluid connection with a pump configured to pump fluid from the fluid reservoir 23 to the one or more main compartments 16, 17.

The system in embodiments of the present disclosure may further include means for fixing the system against a rigid body 3, the rigid body may be a ceiling or a wall (not shown), wherein such means may include a body 30, and one or more power screws 31, or one or more fixing elements 520.

In embodiments of the present disclosure, the one or more fixing elements 520 may include a multiple coaxial double threaded member 57 with a flange 56. The multiple coaxial double threaded members 57 can move in a coaxial twisting movement relative to each other, and the flange 56 may be configured to be tangential to the rigid body 30.

The components forming the system of the present disclosure may be manufactured from food-grade materials, such as high-density polyethylene, or concrete depending on the type of application.

The building system of the present disclosure can be considered as an architectural do-it-yourself project for interior use without any need for specialized tools.

In some embodiments, the building system of the present disclosure can be used for remodeling activities in an interior target space.

In other embodiments, the building system of the present disclosure may be used for fishkeeping.

As used herein, the term "adjacent" may refer to an object that is touching another object and share the same vertical line.

In the present disclosure, the singular forms "a," "an," and "the" include plural referents unless the context clearly dictates otherwise.

As used herein, the term "and/or" when used in the context of a listing of entities, refers to the entities being present singly or in combination. Thus, for example, the phrase "A, B, C, and/or D" includes A, B, C, and D individually, but also includes any and all combinations and sub-combinations of A, B, C, and D.

While the invention has been described in detail and with reference to specific embodiments thereof, it will be apparent to one skilled in the art that various additions, omissions, and modifications can be made without departing from the spirit and scope thereof. Although the above description contains many specificities, these should not be construed as limitations on the scope of the invention but is merely representative of embodiments of this invention. Embodiments of the invention described above are intended to be exemplary only.

What is claimed is:

1. A building block, comprising:

a body comprising an upper end, a lower end, and a plurality of holes configured to receive a back separable cover and a front separable cover, the body having a first side between a low point of the upper end and a high point of the lower end and a second side between a high point of the upper end and a low point of the lower end, a first extension direction along the first side being parallel to a second extension direction along the second side, the first side, second side, upper end, and lower end defining a substantially trapezoidal form;

a first main compartment;

an inner pass-through opening;

a first set of tapered lateral protrusions defining a first lateral dove-tail passageway; and a second set of tapered lateral protrusions defining a second lateral dove-tail passageway, wherein the upper end comprises a protrusion extending in the first and second extension direction of the building block beyond the upper end in the trapezoidal form, wherein the lower end comprises (i) a slot and (ii) an intrusion, the intrusion intruding into the lower end in a direction of the upper end and removing a volume so as to accommodate the protrusion, wherein the lower end and upper end are flanged such that the upper end connects with the lower end in the slot of the lower end, and wherein, if present, the front and back separable covers are configured to substantially cover the first main compartment.

2. The building block of claim 1, wherein the inner pass-through opening is configured to receive electrical or telecommunication wiring and/or plumbing connections.

3. The building block of claim 1, wherein the front separable cover if present comprises a planting pot.

4. The building block of claim 1, wherein the plurality of holes are configured to accommodate press-fit pins.

5. The building block of claim 1, wherein the body further comprises a groove in a thickness direction of the body adapted to receive gaskets or protrusions of the front and back separable covers.

6. The building block of claim 1, further comprising:

a first joining member configured to (i) connect two horizontally adjacent building blocks, and (ii) be inserted in a space gap formed by mating the first lateral dove-tail passageway of two horizontally adjacent building blocks.

7. The building block of claim 1, further comprising:

a second joining member configured to (i) connect two horizontally adjacent building blocks, and (ii) be inserted in a space gap formed by mating the second lateral dove-tail passageway of two horizontally adjacent building blocks.

8. The building block of claim 6, wherein the first joining member comprises two opposed intrusions adapted to receive two opposed extrusions of a vertically adjacent second joining member.

9. The building block of claim 1, wherein the the slot of the lower end is configured to receive a protrusion of an upper end of a vertically adjacent building block, thus achieving an interlocking connection between two vertically adjacent building blocks.

10. The building block of claim 1, further comprising:

the front and hack separable covers.

11. A hexagonal building block, comprising a first and a second of building block of claim 1, formed integrally into a shape substantially resembling a hexagon.

12. A building system, comprising:

a plurality of the building blocks of claim 1; and a base.

13. The building system of claim 12, further comprising:

a fixing element for fixing the system against a rigid body.

14. The building system of claim 13, wherein the fixing element comprises power screws.

15. The building system of claim 13, wherein the fixing elements comprise multiple coaxial double-threaded elements that are able to move in a twisted movement relative to each other, and a flange.

16. The building system of claim 13, wherein the base comprises a plurality of the fixing element, and a lifting mechanism, and wherein each fixing element is configured to receive a substantial part of the building blocks.

17. The building system of claim 16, wherein the lifting mechanism is configured to change the elevation of the building blocks with reference to a rigid body, and wherein the lifting mechanism comprises a scissor lift, and a handle in operable connection with the scissor lift.

18. The building system of claim 12, wherein the base further comprises a fluid reservoir.

19. The building system of claim 12, wherein the base further comprises a fluid pump configured to pump fluid from a fluid reservoir to the first main compartment of a building block.

20. The building block of claim 1, further comprising:

a second main compartment.

* * * * *